US009988931B2

(12) United States Patent
Shteyman et al.

(10) Patent No.: US 9,988,931 B2
(45) Date of Patent: Jun. 5, 2018

(54) TURBINE EXHAUST CYLINDER/ TURBINE EXHAUST MANIFOLD BOLTED PART SPAN TURBINE EXHAUST FLAPS

(71) Applicant: Siemens Energy, Inc., Orlando, FL (US)

(72) Inventors: Yevgeniy P. Shteyman, West Palm Beach, FL (US); John Giaimo, Palm Beach Gardens, FL (US); Daniel M. Eshak, Orlando, FL (US); John A. Orosa, Palm Beach Gardens, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 609 days.

(21) Appl. No.: 14/689,111

(22) Filed: Apr. 17, 2015

(65) Prior Publication Data

US 2016/0076398 A1 Mar. 17, 2016

Related U.S. Application Data

(60) Provisional application No. 62/050,250, filed on Sep. 15, 2014.

(51) Int. Cl.
*F01D 25/04* (2006.01)
*F01D 25/30* (2006.01)
*F01D 25/16* (2006.01)

(52) U.S. Cl.
CPC ..... *F01D 25/04* (2013.01); *F01D 25/16* (2013.01); *F01D 25/30* (2013.01); *F05D 2230/60* (2013.01); *F05D 2260/96* (2013.01)

(58) Field of Classification Search
CPC ..... F01D 2525/30; F01D 2525/165; F01D 2525/16; F01D 2525/04; F01D 9/041; F01D 25/30; F01D 25/165; F01D 25/16; F01D 25/04; F05D 2250/281; F05D 2260/96; F05D 2260/961; F05D 2240/122; F05D 2240/127
See application file for complete search history.

(56) References Cited

U.S. PATENT DOCUMENTS 3,337,121 A * 8/1967 Coanda ..... B63H 11/10 417/167
2013/0152592 A1* 6/2013 Orosa ..... F01D 25/305 60/772

OTHER PUBLICATIONS

Nelson Stud Welding, Inc., "Stud Welding—CPL Partially Threaded Studs", Nelson Stud Welding, Inc., Standard Stock Products Catalog, Feb. 2004, p. 22.

* cited by examiner

*Primary Examiner* — Woody Lee, Jr.
*Assistant Examiner* — Maxime Adjagbe

(57) ABSTRACT

A system and method to minimize flow induced vibration in a gas turbine exhaust is provided. The system includes a turbine exhaust manifold connected to a turbine exhaust cylinder establishing a fluid flow path, the fluid flow path bounded radially outward by an outer cylindrical surface and bounded radially inward by an inner cylindrical surface. At least one tangential strut is arranged between the outer cylindrical surface and the inner cylindrical surface. A first flap is arranged diagonally between the tangential strut and the outer cylindrical surface or the inner cylindrical surface where the first flap minimizes vortex shedding of the fluid flow from the tangential strut.

18 Claims, 4 Drawing Sheets

TURBINE EXHAUST CYLINDER/ TURBINE EXHAUST MANIFOLD BOLTED PART SPAN TURBINE EXHAUST FLAPS

This application claims the benefit of the priority date of U.S. Provisional Patent Application Ser. No. 62/050,250, titled "Turbine Exhaust Cylinder/Turbine Exhaust Manifold Bolted Part Span TE Flaps", filed Sep. 15, 2014.

BACKGROUND

1. Field

The present application relates to gas turbines, and more particularly to a system and method to minimize flow induced vibration in a gas turbine exhaust system.

2. Description of the Related Art

The turbine exhaust cylinder and the turbine exhaust manifold are coaxial gas turbine casing components connected together establishing a fluid flow path for the gas turbine exhaust. The fluid flow path includes an inner flow path and an outer flow path defined by an inner diameter delimiting an outer cylindrical surface of the inner flow path and an outer diameter delimiting an inner cylindrical surface of the outer flow path, respectively. Tangential struts are arranged within the fluid flow path and serve several purposes such as supporting the flow path and providing lubrication for the turbine and rotor bearing. At certain conditions, the exhaust flow around the tangential struts can cause vibrations of the inner and outer diameter of the turbine exhaust cylinder and the turbine exhaust manifold due to vortex shedding. Vortex shedding is an unsteady flow phenomenon typically caused by high incidence on the tangential struts. It may cause large oscillations in flowpath pressures that force the flowpath structure to vibrate or even resonate strongly. These vibrations are a potential contributor to damage occurring on the flow path of the turbine exhaust manifold and the turbine exhaust cylinder. This damage to the casing components may require replacement or repair.

SUMMARY

Briefly described, aspects of the present disclosure relates to a system to minimize flow induced vibration in a gas turbine exhaust and a method to minimize flow induced vibration in a flow path of a gas turbine exhaust manifold and/or the gas turbine exhaust cylinder.

A first aspect of provides a system to minimize flow induced vibration in a gas turbine exhaust. The system includes a turbine exhaust manifold connected to a turbine exhaust cylinder establishing a fluid flow path, the fluid flow path bounded radially outward by an outer cylindrical surface and bounded radially inward by an inner cylindrical surface. At least one tangential strut is arranged between the outer cylindrical surface and the inner cylindrical surface. A first flap is arranged diagonally between the tangential strut and the outer cylindrical surface or the inner cylindrical surface where the first flap minimizes vortex shedding of the fluid flow from the tangential strut.

A second aspect of provides a method to minimize flow induced vibration in a flow path of a gas turbine exhaust manifold and/or the gas turbine exhaust cylinder. The method includes disposing a first flap between an outer cylindrical surface or an inner cylindrical surface of the flow path and a tangential strut, attaching the first flap to the outer cylindrical surface or the inner cylindrical surface using a first sliding joint, and attaching the first flap to the tangential strut using a second sliding joint. The first flap minimizes vortex shedding of the fluid flow from the tangential strut.

DETAILED DESCRIPTION

To facilitate an understanding of embodiments, principles, and features of the present disclosure, they are explained hereinafter with reference to implementation in illustrative embodiments. Embodiments of the present disclosure, however, are not limited to use in the described systems or methods.

The components and materials described hereinafter as making up the various embodiments are intended to be illustrative and not restrictive. Many suitable components and materials that would perform the same or a similar function as the materials described herein are intended to be embraced within the scope of embodiments of the present disclosure.

Damage to gas turbine casing components is an issue that may be caused by vibrations within the inner and outer flow path of the gas turbine exhaust system. In particular, vibrations such as panel modes and/or critical modes may be flow induced vibrations excited by vortex shedding from the tangential struts. Panel modes are mode shapes of panels. In structural dynamics, mode shapes are three-dimensional deformation shapes of an elastic component. Critical modes are mode shapes that couple with the forcing function or energy input and are especially problematic because they may create damage to the casing components, particularly to the flow path of the gas turbine.

An approach to avoid component damage to the casing components caused by vibrations would be to introduce a plurality of part span flaps slideably attached to the turbine exhaust cylinder and/or turbine exhaust manifold tangential struts to mitigate the vortex shedding from the tangential struts. The part span flaps may be located near the outer diameter of the flow path and/or near the inner diameter of the flow path where vortex shedding occurs and are used to minimize the flow induced vibrations in the gas turbine exhaust. The installation of the part span flaps may be accomplished in a reasonable time frame, for example, within 24 hours. Additionally, the attachment scheme of the flaps within the gas turbine exhaust system does not damage or reconfigure the existing hardware such that the part span flaps may be removed when desired.

Figure 1:
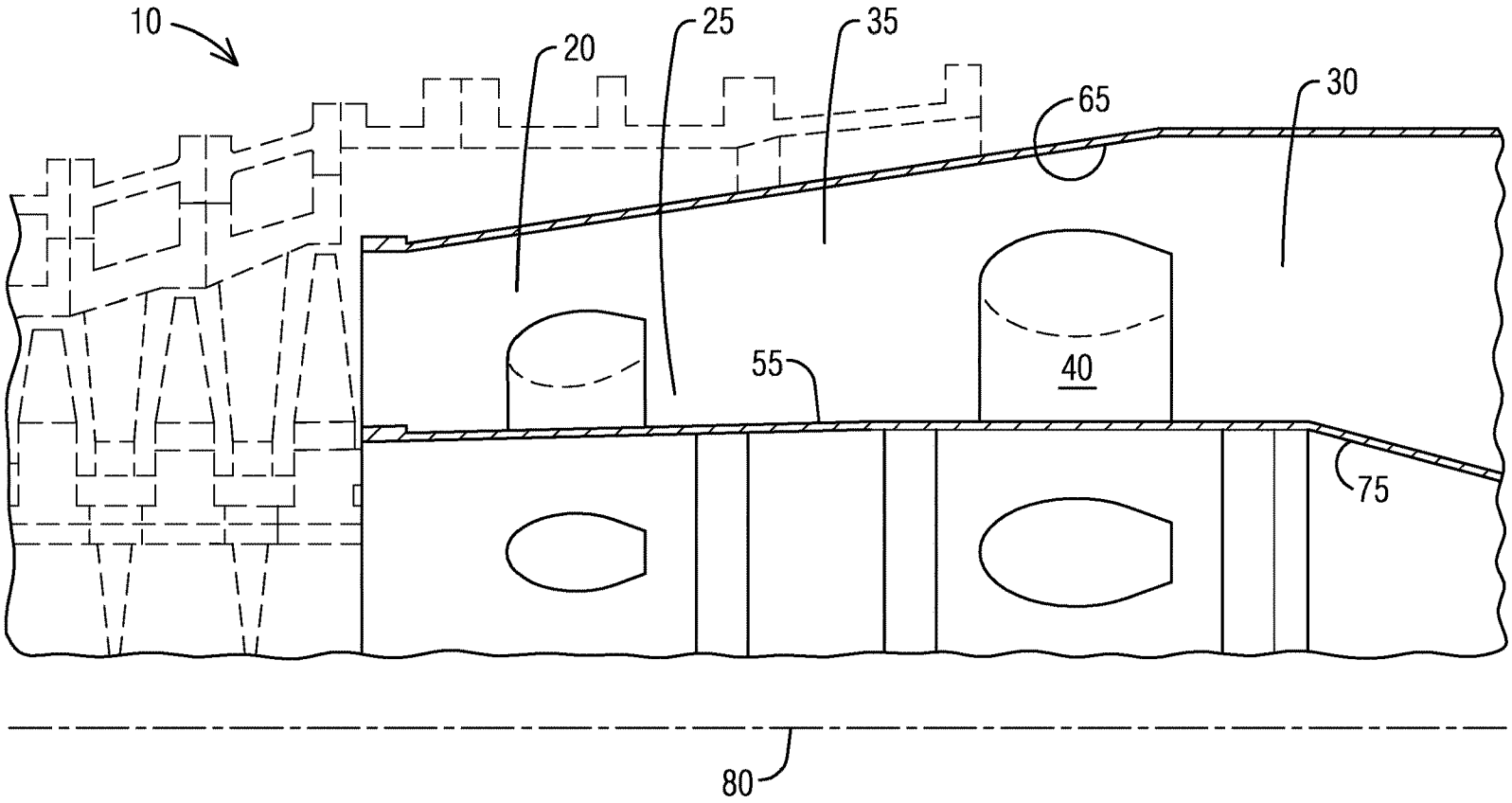
FIG. 1 . . . illustrates a longitudinal view of the exhaust system of a gas turbine, FIG. 2 . . . illustrates a longitudinal view of the exhaust system a gas turbine including turbine exhaust manifold part span flaps, FIG. 3 . . . illustrates a perspective view of the first and second part span flaps attached to a first and second plate, respectively, FIG. 4 . . . illustrates a front view of a first diagonal flap and a second flap attached to the tangential strut using sliding joints, FIG. 5 . . . illustrates a partial perspective view of a flap attached to a mounting surface using a sliding joint, and FIG. 6 . . . illustrates a cross sectional view of FIG. 5's sliding joint.

FIG. 1 illustrates a longitudinal view of the exhaust system (10) of a gas turbine. The turbine exhaust system (10) is disposed in the aft portion of the turbine section of the gas turbine and includes a turbine exhaust cylinder (20) and a turbine exhaust manifold (30). The turbine exhaust manifold (30) is connected downstream from the turbine exhaust cylinder (20) and establishes a fluid flow path, the fluid flow path includes an inner flow path (25) and outer flow path (35). The fluid flow path is bounded radially inward by an inner cylindrical surface (55) and radially outward by an outer cylindrical surface (65) with respect to a rotor centerline (80). Struts (40) are hollow tubes that may extend between the inner flow path (25) to the outer flow path (35).

Figure 2:
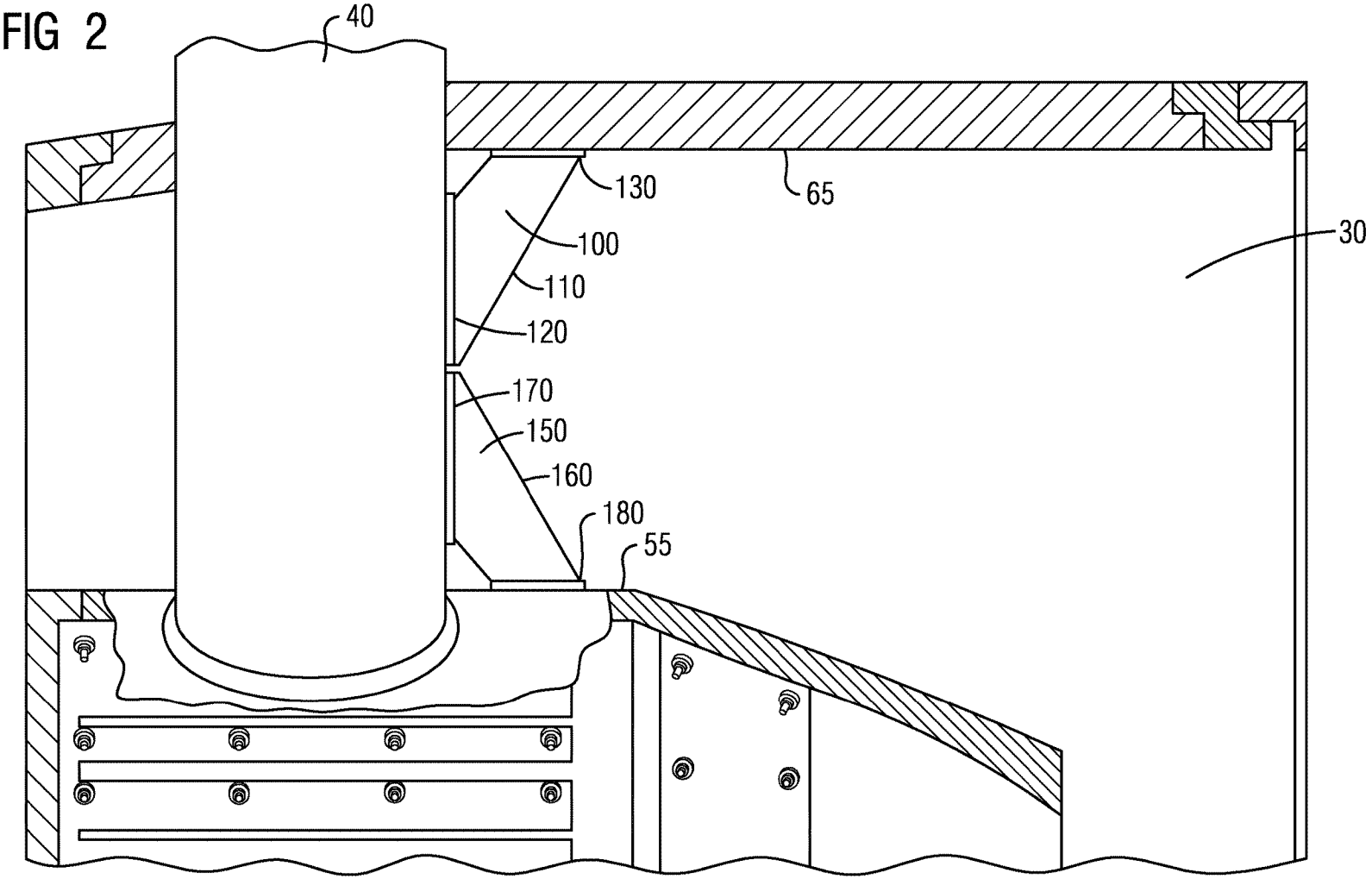

FIG. 2 illustrates a longitudinal view of the turbine exhaust manifold (30) including two part span flaps (100, 150) attached to the shown tangential strut (40). In the shown embodiment, the two flaps (100, 150) are arranged between the tangential strut (40) and the cylindrical surfaces of the flow path. A first flap (100) is arranged diagonally between the tangential strut (40) and the outer cylindrical surface (65) and a second flap (150) is arranged between the tangential strut (40) and the inner cylindrical surface (55). In the shown embodiment, two diagonal flaps (100, 150) are shown, however, one diagonal flap positioned between the tangential strut (40) and the inner cylindrical surface (55) or the outer cylindrical surface (65) may also be used alone depending on what portions of the tangential strut span is shedding vorticesflow induced vibration. Additionally, the shown embodiment illustrates the first flap (100) and the second flap (150) are essentially mirror images of each other, however, the first flap (100) and the second flap (150) may have different geometries.

The geometry of the diagonal flap (100, 150) may include a trailing edge (110, 160) that extends diagonally from the outer cylindrical surface (65) or the inner cylindrical surface (55) to a position on the tangential strut (40). One skilled in the art would understand that the trailing edge may also include any generalized shape commonly used for aerodynamic wings and tail fins. The flap (100, 150) may also include a radial edge (120, 170) that extends radially with respect to the rotor centerline (80) along the tangential strut (40) and as well as an axial edge (130, 180) that extends axially with respect to the rotor centerline (80) along the outer cylindrical surface (65) or the inner cylindrical surface (55).

Each of the components within the flow path of the turbine exhaust cylinder/turbine exhaust manifold (20, 30) may have a different thermal mass with the result that these components thermally grow, i.e., contract or expand, differently. For example, the tangential strut (40) may heat up slower in response to the heated fluid flow within the flow path than the flap (100, 150) due to its greater thermal mass. The components within the flow path may include the tangential strut (40), the part span flap (100, 150), the inner cylindrical surface (55) and the outer cylindrical surface (65). Thus, the attachment of the flap (100, 150) should be flexible enough to accommodate the differential thermal growth of the flow path components while keeping the joint between the flap (100, 150) and the tangential strut (40) and/or between the flap (100, 150) the inner cylindrical surface (55) or the outer cylindrical surface (65) tight. An attachment scheme suitable for the above criteria may be accomplished using a plurality of sliding joints such that the radial edge (120, 170) and/or the axial edge (130, 180) of the flap (100, 150) are slideably attached to the tangential strut (40) and/or the inner or outer cylindrical surfaces (55, 65), respectively.

Figure 3:
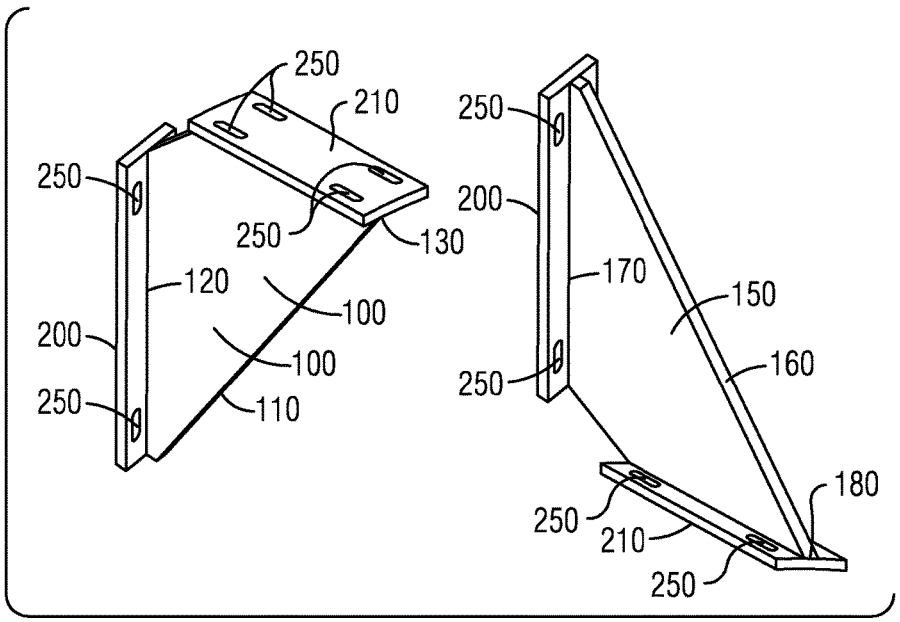

FIG. 3 illustrates a perspective view of the first flap (100) and the second flap (150) of FIG. 2 where the first flap (100) may be arranged diagonally between the tangential strut (40) and the outer cylindrical surface (65) and a second flap (150) may be arranged diagonally between the tangential strut (40) and the inner cylindrical surface (55). In the shown embodiment, the radial edge (120, 170) of the flap (100, 150) is attached to a first plate (200) and the axial edge is attached to a second plate (210). The radial edge (120, 160) and the axial edge (130, 180) may be attached to the first plate (200) and the second plate (210), respectively, for example, by welding.

The first plate (200) and second plate (210) may include at least one set of elongated holes (250). FIG. 3 illustrates the first plate and the second plate (200, 210) each having two sets of elongated holes (250), one on either side of the diagonal flap (100, 150). Each elongated hole (250) may be racetrack shaped such that two sides of the elongated hole (250) are flat and parallel to one another connected by two curved sides.

The second plate (210) may be curved in order to facilitate mating with the inner cylindrical surface (55) or the outer cylindrical surface (65) and/or to minimize potential bending loads on a plurality of welded threaded rods that may be used to couple the diagonal flap (100, 150) to a mounting surface (40, 55, 65) which may include the tangential strut (40), the inner cylindrical surface (55), and the outer cylindrical surface (65). For illustrative purposes, the tangential strut (40), the inner cylindrical surface (55), or the outer cylindrical surface (65) will be described hereinafter as the mounting surface (40, 55, 65).

Figure 4:
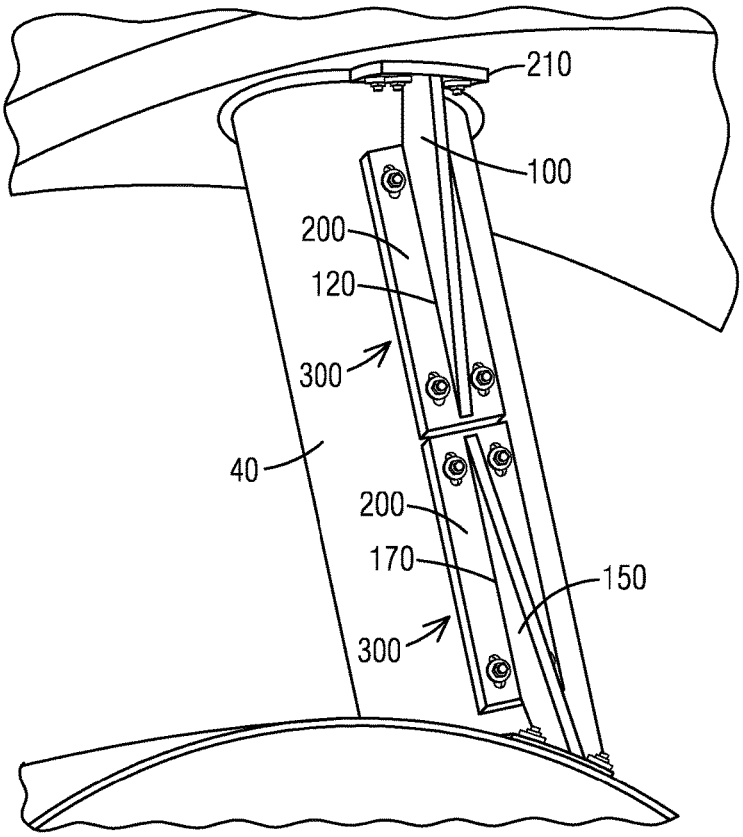

FIG. 4 illustrates a front view of the first flap (100) and the second flap (150) slideably attached to the mounting surfaces (40, 55, 65) using sliding joints (300). As shown, in the radial direction, the first flap (100) extends from the outer cylindrical surface (65) to a first position on the tangential strut (40) between the outer cylindrical surface (65) and the inner cylindrical surface (55) and the diagonal flap (150) extends from the inner cylindrical surface (55) to a second position on the tangential strut (40) between the outer cylindrical surface (65) and the inner cylindrical surface (55). The sliding joints (300) permit tangential motion to which mounting surface (40, 55, 65) the sliding joint (300) is attached while providing a rigid connection in the perpendicular direction.

Figure 5:
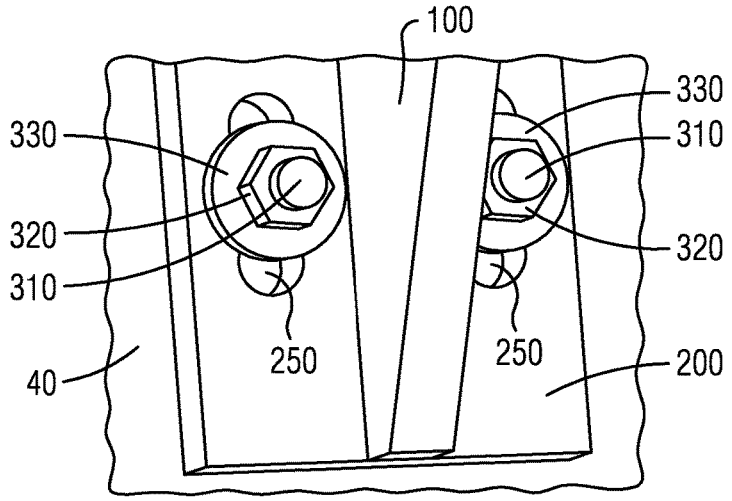

FIG. 5 illustrates a partial perspective view of an attachment of the flap (100) to a mounting surface (40, 55, 65) using a sliding joint (300). In the illustrated embodiment, in order to create the sliding joint (300), the first plate (200) is positioned to abut the respective mounting surface (40). The second plate (210) may also be positioned to abut the mounting surface (55, 65) using a sliding joint (300).

Each first plate (200) and second plate (210) includes at least one set of elongated holes (250), each elongated hole (250) may be racetrack shaped as described above. Each elongated hole (250) shown includes a radial threaded rod (310) protruding through the elongated hole (250). The radial threaded rod (310) may be coupled to the mounting surface (40, 55, 65), for example, welded to the mounting surface (40, 55, 65). Surrounding the radial threaded rod (310) and fitting into each elongated hole (250) shown is a bushing (330). Each bushing (330) also abuts the mounting surface (40, 55, 65). A fastener (320), such as a nut, may be used to secure the bushing (330) and radial threaded rod (310) to the first plate (200) or second plate (210).

Figure 6:
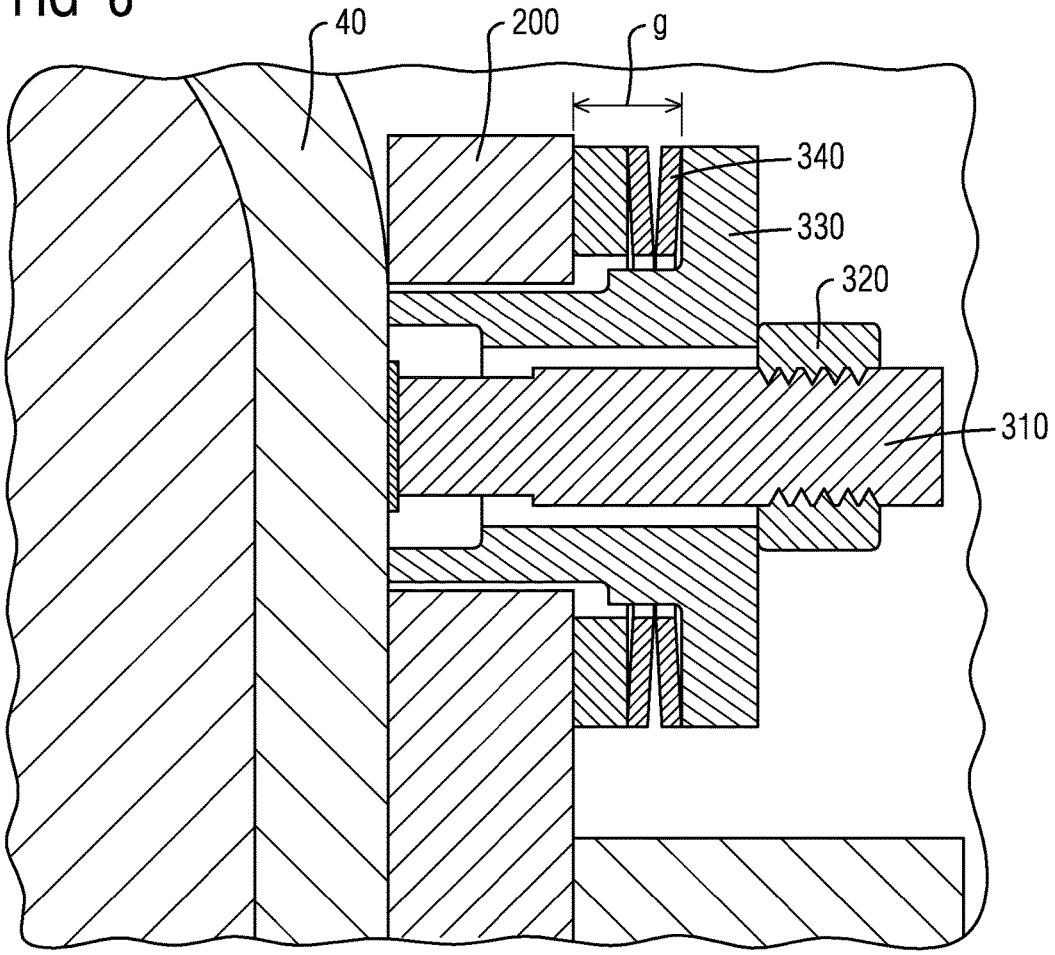

FIG. 6 illustrates a cross section of the elongated hole (250) of FIG. 5. In the shown embodiment, the radial threaded rod (310) is centrally located within the elongated hole (250) and welded to the mounting surface (40, 55, 65). The radial threaded rod (310) protrudes through the elongated hole (250) such that it protrudes past the surface of the first plate (200) or second plate (210). The bushing (330) is shown surrounding the radial thread rod (310). The bushing (330) may include flat sides that mate with the flat sides of the elongated hole (250). The fastener (320), shown as a nut, is used to secure the bushing (330) and radial threaded rod (310) to the first plate (200) or the second plate (210). Additionally, the cross sectional view shows a gap (g) exists between an undersurface of the bushing (330) and a surface of the first plate (200) or second plate (210). Within the gap (g), a locking spring washer (340) is disposed.

The gap (g) may be sized to sufficiently compress the locking spring washer (340) in order to hold the flap (100, 150) onto the mounting surface (40, 55, 65). This compression of the locking spring washer (340) may allow each sliding joint (300) to slide within the elongated hole (250) accommodating the differential thermal growth of the flap (100, 150) and the mounting surfaces (40, 55, 65). The first plate (200) allows the flap (100, 150) to slide radially along the tangential strut (40) while the second plate (210) allows the flap (100, 150) to slide axially along the inner cylindrical surface (55) or the outer cylindrical surface (65).

Referring to FIGS. 1-6, a method to minimize flow induced vibration in a flow path of a gas turbine exhaust manifold (30) or gas turbine exhaust cylinder (20) is also provided. In an embodiment, a first flap (100) is disposed between an outer cylindrical surface (65) or an inner cylindrical surface (55) of the flow path and the tangential strut (40). The first flap (100) may then be attached to the outer cylindrical surface (65) or the inner cylindrical surface (55) using a first sliding joint (300) and to the tangential strut (40) using a second sliding joint (300). In another embodiment, the first (100) and a second diagonal flap (150) are disposed such that the first flap (100) is disposed between the outer cylindrical surface (65) and the tangential strut (40) and the second flap (150) is disposed between the inner cylindrical surface (55) and the tangential strut (40).

As shown in FIG. 2 and mentioned previously, the geometry of the flap (100, 150) may include a trailing edge (110, 160) that extends diagonally from the outer cylindrical surface (65) or the inner cylindrical surface (55) to a position on the tangential strut (40), a radial edge (120, 170) that extends radially with respect to the rotor cenerline (80) along the tangential strut (40) and as well as an axial edge (130, 180) that extends axially with respect to the rotor centerline (80) along the outer cylindrical surface (65) or the inner cylindrical surface (55). The radial edge (120, 170) may be attached to the tangential strut (40) using the first sliding joint (300) while the axial edge (130, 180) may be attached to the inner cylindrical surface (55) or the outer cylindrical surface (65) using the second sliding joint.

The radial edge (120, 170) may be coupled to a first plate (200) and the axial edge (130, 180) may be coupled to a second plate (210). As described previously, the first plate (200) and the second plate (210) each includes a least one set of elongated holes (250). The coupling of the radial (120, 170) and/or axial edges (130, 180) may be done by welding for example.

The radial edge (120, 170) may be attached to the tangential strut (40) using a first sliding joint (300) and the axial edge (130, 180) may be attached to the outer cylindrical surface (65) or the inner cylindrical surface (55) using a second sliding joint (300). As illustrated in the figures, the illustrated sliding joints (300) are attached to a mounting surface (40, 55, 65) similarly, however, one skilled in the art would understand that other procedures to attach the sliding joints (300) to a mounting surface (40, 55, 65) may be used.

In order to attach the first plate (200) and the second plate (210) to the respective mounting surface (40, 55, 65), both the first plate (200) and the second plate (210) may first be disposed against the mounting surface (40, 55, 65) such that each plate abuts the respective mounting surface (40, 55, 65). A plurality of radial threaded rods (310) may be coupled to the mounting surface (40, 55, 65) such that each radial threaded rod (310) is disposed so that it protrudes through a respective elongated hole (250). The coupling of the radial threaded rods (310) to the mounting surface (40, 55, 65) may be accomplished by welding, for example. A plurality of bushings (330) are inserted each into a respective elongated hole (250) such that the flat sides of the bushing (330) abut corresponding flat sides of the respective elongated hole (250) and the bushing (330) abuts the mounting surface (40, 55, 65). Each radial threaded rod (310) may be secured to the bushing (330) using a nut tack welded to the bushing (330), for example.

A gap (g) exists between an undersurface of the bushing (330) and a surface of the first plate (200) or second plate (210). Within the gap (g), a locking spring washer (340) is disposed. In order to hold the first diagonal flap (100) or the second diagonal flap (150) onto the surface of the first plate (200) and/or the second plate (210), the gap (g) would be sufficiently sized to compress the spring loaded washer (340). This compression allows the first sliding joint (300) and/or the second sliding joint (300) to slide within each elongated hole (250) accommodating the differential thermal growth of the mounting surfaces (40, 55, 65). The first and second sliding joints (300) permit tangential motion to which mounting surface the sliding joint is attached while providing a rigid connection in the perpendicular direction.

The system and corresponding method provides a way to effectively reduce or eliminate vortex shedding in the critical areas of the turbine exhaust system flow path and decrease or eliminate the critical mode response without compromising the components' structural integrity. The flaps may be easily installed and easily removed such that their installation may be accomplished in a reasonable amount of time, for example 24 hours. Additionally, the attachment scheme of the diagonal flaps does not affect existing hardware.

While embodiments of the present disclosure have been disclosed in exemplary forms, it will be apparent to those skilled in the art that many modifications, additions, and deletions can be made therein without departing from the spirit and scope of the invention and its equivalents, as set forth in the following claims.

What is claimed is:

1. A system to minimize flow induced vibration in a gas turbine exhaust, comprising:

a turbine exhaust manifold connected to a turbine exhaust cylinder establishing a fluid flow path, the fluid flow path bounded radially outward by an outer cylindrical surface and bounded radially inward by an inner cylindrical surface;

a tangential strut arranged between the outer cylindrical surface and the inner cylindrical surface; and a first flap arranged diagonally between the tangential strut and the outer cylindrical surface or the inner cylindrical surface, wherein the first flap minimizes vortex shedding of the fluid flow from the tangential strut, wherein the first diagonal flap extends from the outer cylindrical surface to a first position on the tangential strut between the outer cylindrical surface and the inner cylindrical surface, and wherein a second flap extends from the inner cylindrical surface to a second position on the tangential strut between the outer cylindrical surface and the inner cylindrical surface.

2. The system as claimed in claim 1, wherein a trailing edge of the first flap extends from the outer cylindrical surface or the inner cylindrical surface to a position on the tangential strut, and wherein the first flap includes a radial edge that extends radially with respect to a rotor centerline along the tangential strut and an axial edge that extends axially with respect to the rotor centerline along the outer cylindrical surface or the inner cylindrical surface.

3. The system as claimed in claim 1, wherein the first flap and the second flap are a mirror image of each other.

4. The system as claimed in claim 2, wherein the radial edge is slideably attached to the tangential strut(40) using a first sliding joint, and wherein the axial edge is slideably attached to the outer cylindrical surface or the inner cylindrical surface using a second sliding joint.

5. The system as claimed in claim 4, wherein each sliding joint comprises:

a plate abutting a mounting surface, the plate including a set of elongated holes, a plurality of bushings, each bushing fitting within a respective elongated hole and abutting the mounting surface, a plurality of radial threaded rods, each rod is welded to the mounting surface fits within a bushing, and protrudes through the respective elongated hole, a locking spring washer disposed between the bushing and the plate, and a plurality of fasteners, each fastener securing the bushing and radial threaded rod to the plate, wherein the mounting surface includes the inner cylindrical surface (55), the outer cylindrical surface or the tangential strut.

6. The system as claimed in claim 2, wherein the radial edge is attached to a first plate, wherein the axial edge is attached to a second plate.

7. The system as claimed in claim 5, wherein each bushing includes at least two flat sides to abut flat sides of the respective elongated hole, wherein a gap exists between a surface of the plate and an opposing surface of the bushing, wherein the locking spring washer is disposed within the gap, and wherein the gap is sized to sufficiently compress the locking spring washer in order to hold the first flap onto the mounting surface.

8. The system as claimed in claim 7, wherein the compression of the locking spring washer allows each sliding joint to slide within the elongated hole accommodating the differential thermal growth of the first flap and the mounting surface, and wherein each sliding joint permits tangential motion to which mounting surface the sliding joint is attached while providing a rigid connection in the perpendicular direction.

9. A method to minimize flow induced vibration in a flow path of a gas turbine exhaust manifold and/or the gas turbine exhaust cylinder, comprising:

disposing a first flap between an outer cylindrical surface or an inner cylindrical surface of the flow path and a tangential strut;

attaching the first flap to the outer cylindrical surface or the inner cylindrical surface using a first sliding joint;

attaching the first flap to the tangential strut using a second sliding joint;

wherein the flow path is bounded radially outward by an outer cylindrical surface and bounded radially inward by an inner cylindrical surface, wherein the first flap minimizes vortex shedding of the fluid flow from the tangential strut.

10. The method as claimed in claim 9 comprising, providing a trailing edge of the first flap extending from the outer cylindrical surface or the inner cylindrical surface to the tangential strut, and providing a radial edge of the first diagonal flap extending radially, with respect to the rotor centerline, along the tangential strut and providing an axial edge extending axially along the outer cylindrical surface or the inner cylindrical surface.

11. The method as claimed in claim 10, wherein the radial edge is attached to the tangential strut using the first sliding joint, and wherein the axial edge is attached to the outer cylindrical surface or the inner cylindrical surface using the second sliding joint.

12. The method as claimed in claim 10, wherein the radial edge is coupled to a first plate, wherein the axial edge is coupled to a second plate, and wherein the first plate and the second plate each include a set of elongated holes.

13. The method as claimed in claim 12, wherein the first plate is disposed against the tangential strut such that first plate abuts the tangential strut, wherein the second plate is disposed against the inner cylindrical surface or the outer cylindrical surface such that the second plate abuts the inner cylindrical surface or the outer cylindrical surface, respectively.

14. The method as claimed in claim 13, wherein the attaching includes:

coupling a plurality of threaded radial rods to a mounting surface, disposing each radial threaded rod on the mounting surface such that each radial threaded rod protrudes through a respective elongated hole, and wherein the mounting surface includes the inner cylindrical surface, the outer cylindrical surface, or the tangential strut.

15. The method as claimed in claim 14, wherein the attaching includes:

inserting a bushing, the bushing including at least two flat sides, such that the flat sides about flat sides of the respective elongated hole, the bushing abuts the mounting surface and a gap exists between a surface of the first plate or second plate and an opposing surface of the bushing, disposing a spring loaded washer within the gap, wherein the gap is sized to sufficiently compress the spring loaded washer in order to hold the first flap onto the surface of the first plate or the second plate.

16. The method as claimed in claim 14, wherein the attaching includes securing each radial threaded rod to the bushing using a nut tack welded to the bushing.

17. The method as claimed in claim 15, wherein the compression of the spring loaded washer allows the first sliding joint and/or the second sliding joint to slide within the elongated hole accommodating the differential thermal growth of the first flap and the mounting surface, and wherein the first sliding joint and the second sliding joint permit tangential motion to which mounting surface the sliding joint is attached while providing a rigid connection in the perpendicular direction.

18. The method as claimed in claim 9, wherein the first flap is disposed between the outer cylindrical surface and the tangential strut, and wherein a second flap is disposed between the inner cylindrical surface and the tangential strut.

* * * * *